United States Patent [19]

Jaroschek et al.

[11] Patent Number: 4,851,138

[45] Date of Patent: Jul. 25, 1989

[54] FABRIC SOFTENING COMPOSITION AND DETERGENT-COMPOSITION COMPRISING THE SAME

[75] Inventors: Hans-Joachim Jaroschek, Kerpen; Hans Rörig, Merzenich, both of Fed. Rep. of Germany; Hendrik van Brederode, Dieren, Netherlands

[73] Assignee: Akzo, N.V., Netherlands

[21] Appl. No.: 91,991

[22] Filed: Sep. 2, 1987

[30] Foreign Application Priority Data

Sep. 2, 1986 [EP] European Pat. Off. ..... 86201512
Feb. 25, 1987 [EP] European Pat. Off. ..... 87200321

[51] Int. Cl.[4] ..... D06M 00/00

[52] U.S. Cl. ..... 252/88; 252/120; 252/94

[58] Field of Search ..... 252/8.8

[56] References Cited

U.S. PATENT DOCUMENTS

| | | | |
|---|---|---|---|
| 3,231,508 | 1/1966 | Lew | 252/152 |
| 3,285,856 | 11/1966 | Lew | 252/152 |
| 3,305,417 | 1/1975 | Nirschl | 252/131 |
| 3,886,075 | 5/1975 | Bernardino | 252/8.75 |
| 3,936,537 | 2/1975 | Baskerville | 427/242 |
| 4,497,715 | 2/1985 | Bauman | 252/8.8 |
| 4,497,716 | 2/1985 | Tai | 252/8.8 |
| 4,676,915 | 6/1987 | Steltenkamp | 252/8.8 |

FOREIGN PATENT DOCUMENTS

| | | |
|---|---|---|
| 0026528 | 4/1981 | European Pat. Off. . |
| 0026529 | 4/1981 | European Pat. Off. . |
| 0159918 | 10/1985 | European Pat. Off. . |
| 0164797 | 12/1985 | European Pat. Off. . |
| 1959007 | 5/1971 | Fed. Rep. of Germany . |
| 2918363 | 11/1980 | Fed. Rep. of Germany . |
| 2020689 | 11/1979 | United Kingdom . |
| 2141152 | 12/1984 | United Kingdom . |
| 2160886 | 1/1986 | United Kingdom . |
| 2170236 | 7/1986 | United Kingdom . |

OTHER PUBLICATIONS

Kunieda et al., (vol. 82) J. Phys. Chem. (pp. 1710–1713), (1978).

*Primary Examiner*—John F. Niebling
*Assistant Examiner*—Isabelle Rodriguez
*Attorney, Agent, or Firm*—Oliff & Berridge

[57] ABSTRACT

A detergent compatible granular fabric softening composition, comprising a water soluble quaternary ammonium compound, a clay having an ion exchange capacity of at least 50 meq./100 g and one or more amides, imides and urea derivatives according to four specifically defined formulae.

A preferred group of amides to be applied are those according to the formula

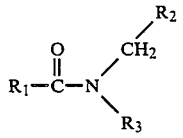

wherein $R_1$ represents a $C_1$–$C_{22}$ alkyl group and wherein $R_2$ and $R_3$, independently, represent hydrogen, $C_1$–$C_{22}$ alkyl, $-(C_2H_4O)_xH$ or $-(C_3H_6O)_xH$ wherein x has a value of 1 to 25, with the provisos that the sum of the carbon atoms of two radicals of $R_1$, $R_2$ and $R_3$ is at least 16 and $R_2$ and $R_3$ are not at the same time hydrogen. More preferred are N-stearylstearamide or N-oleylpalmitamide.

Additionally the invention relates to detergent compositions comprising these softening compositions.

11 Claims, No Drawings

FABRIC SOFTENING COMPOSITION AND DETERGENT-COMPOSITION COMPRISING THE SAME

The present invention relates to a detergent compatible granular fabric softening composition comprising a water-soluble quaternary ammonium compound and a clay having an ion-exchange capacity of at least 50 meq/100 grams. This softening composition is known from European Patent Specification No. 0,026,529. It is incorporated into detergent compositions containing an anionic surfactant. In said specification a solution is proposed to the problem of formulating a detergent composition having good cleaning and softening properties. In this way it should be tried to prevent the quaternary ammonium compound from interacting with the anionic surfactant which is usuallly present in conventional detergetnt compositions. It is true that by applying this softening system a good combination of cleaning and softening can be obtained. Although the detergent compositions wherein such softening compositions are included show relatively good cleaning and softening characteristics, there is still need for further improvement of the softening characteristics, without detracting from the present level of cleaning properties.

Extensive research and experimentation have resulted in such a desired further improved detergent-compatible granular fabric softening system, which is characterized in that it further comprises one or more amides, imides and urea derivatives selected from the group consisting of compounds having the formula:

(a)

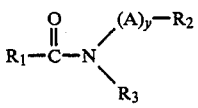

I wherein A represents a methylene or a carbonyl group, wherein y represents 1 or 0, wherein $R_1$ represents a $C_1$–$C_{22}$ alkyl group, wherein $R_2$ and $R_3$, independently, can represent $C_1$–$C_{22}$ alkyl, $-(C_2H_4O)_xH$ or $-(C_3H_6O)_xH$, where x has a value of 1 to 25 with the provisos that the sum of the carbon atoms of two radicals of $R_1$, $R_2$ or $R_3$ is at least 16 and $R_2$ and $R_3$ are not at the same time hydrogen.

(b)

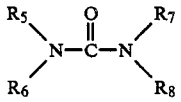

II wherein two of the groups $R_5$, $R_6$, $R_7$ and $R_8$ are the same or different and represent $C_8$–$C_{22}$ alkyl groups and two of the groups $R_5$, $R_6$, $R_7$ and $R_8$ are the same or different and represent hydrogen, $C_1$–$C_{22}$ alkyl, $-(C_2H_4O)_xH$ or $-(C_3H_6O)_xH$, where x has a value of 1 to 25.

(c)

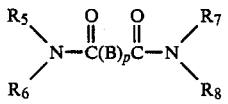

III wherein $R_5$, $R_6$, $R_7$ and $R_8$ have the same meaning as given under b, B represents $C_4$–$C_{10}$ alkylene-1,3 phenylene, 1,4 phenylene, 1,3-cyclohexylene or 1,4-cyclohexylene and wherein p being 0 or 1.

(d)

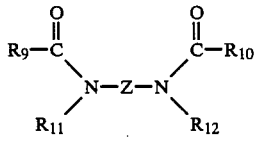

IV wherein Z represents $C_1$–$C_{12}$ alkylene, 1,3-phenylene, 1,4-phenylene, 1,3-cyclohexylene or 1,4-cyclohexylene, $R_9$ and $R_{10}$ are the same or different and represent $C_1$–$C_{21}$ alkyl groups, $R_{11}$ and $R_{12}$ are the same or different and represent hydrogen, $C_1$–$C_{22}$ alkyl, $-(C_2H_4O)_xH$ or $(C_3H_6O)_xH$, wherein x has a value of 1 to 25, or together with the moiety —N—Z—N— form a heterocyclic ring structure such as piperazinylene or imidazolidinylene.

By the term alkyl in the definitions of all groups of the formulae I–IV is meant alkyl groups which are linear, branched, saturated, unsaturated, unsubstituted or substituted by, e.g., a hydroxyl group.

It should be noted that U.S. Pat. No. 3,231,508 and U.S. Pat. No. 3,285,856 disclose the use of N-$C_1$–$C_{22}$ alkyl fatty acid amides as foam suppressors in anionic detergents. No mention is made, however, of the present three-component softening formulation.

It should be further noted that U.S. Pat. No. 4,497,715 discloses the use of a N-$C_{1-18}$ alkylisostearamide adsorbed onto a Bentonite® clay in an anionic detergent composition. The compositions disclosed in this patent are meant to be an alternative and an improvement to the quaternary ammonium compounds.

The present invention, however, provides a three component system, which shows improved fabric softening properties as compared with those of the additives described in U.S. Pat. No. 4,497,715.

From British patent publication GB No. 2,160,886A solid detergent bar articles having a softening action are known. These detergent bar articles contain, besides a great many different ingredients, a long-chain aliphatic amide. This amide is clearly meant to serve as a lathering agent in the form of a fatty acid alkanolamide and is clearly not suggestive at all to persons skilled in the art of the attractive softening properties of the present three-component system.

European patent Specification No. 0,026,528 suggests using a three-component softening composition, the third component being an insoluble tertiary amine instead of the presently proposed amides, imides and/or urea derivatives. As to these prior art compositions containing an insoluble tertiary amine those of the present invention contain amides, imides and urea derivatives, which possess more attractive physiological and physical properties in that they do not produce the unpleasant fishy odour and are less irritant to skin and eyes. Moreover, the tertiary amines, which were practically used for prior art compositions, have melting points which are generally below 40° C., whereas many representatives of the amides, imides and urea derivatives to be applied according to the present invention melt at higher temperatures.

This diminishes the risk of caking of the complete detergent composition into which the amide, imide or urea derivative has been finally incorporated.

Moreover, it was suprisingly found that the use of certain amides as defined hereinbefore, allows a reduction of the content of quaternary ammonium compounds in the final washing compositions, showing superior softening performance compared with the tertiary amine containing compositions.

In particular, the use of stearyl stearamide (in this text, the terms "stearyl" and "hydrogenated tallow alkyl" are used interchangeably) produces such benefits.

More particularly, a proportion of quaternary ammonium compounds of from 0.1 up to 1% in the washing compositions containing the amides according to the present invention results in good cleaning and softening characteristics. It will be appreciated that such an attractive feature of the present compositions can only be regarded as completely unobvious to a person skilled in the art having in mind the generally accepted practical lower limit of these contents in washing compositions of about 0.5 by weight.

In particular, the present softening composition should consist of at least three components selected from:

(a) a water-soluble quaternary ammonium compound (b) a clay having an ion-exchange capacity of at least 50 meq./100 grams of clay and (c) the amide, imide or urea derivative as specified above.

The water soluble quaternary ammonium compound should consist of one or more members selected from the group consisting of compounds of the formulae a-d:

(a)

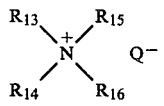

V wherein $R_{13}$ represents $C_8$–$C_{18}$ alkyl being saturated and/or unsaturated, or 2-($C_8$–$C_{18}$-acyloxy)ethyl, wherein $R_{14}$, $R_{15}$ and $R_{16}$ are the same or different and represent $C_1$–$C_4$ alkyl benzyl, 2 methoxy-2-oxoethyl, 2-ethoxy-2-oxoethyl, —$(C_2H_4O)_xH$ or —$(C_3H_6O)_xH$ wherein x has a value from 1 to 5, Q is an anion, e.g. a halide, preferably bromide or chloride, methosulphate or ethosulphate. Of the groups $R_{14}$, $R_{15}$ and $R_{16}$ not more than one group may be benzyl, 2-methoxy-2-oxoethyl or 2-ethoxy-2-oxoethyl.

Examples of suitable representatives of this group (a) are:

1. coco-alkyl trimethyl ammonium chloride
2. coco-alkyl trimethyl ammonium bromide
3. coco-alkyl dimethyl(2-hydroxyethyl)ammonium chloride
4. coco-alkyl dimethyl(2-hydroxyethyl)ammonium bromide.
5. coco-alkyl methyl bis(2-hydroxyethyl)ammonium chloride
6. coco-alkyl methyl bis(2-hydroxyethyl)ammonium bromide
7. myristyl trimethyl ammonium methosulphate
8. lauryl dimethyl benzyl ammonium chloride
9. lauryl methyl(oxyethyleen)ammonium bromide
10. palmityl trimethyl ammonium chloride
11. palmityl trimethyl ammonium bromide
12. tallow-alkyl trimethyl ammonium chloride
13. stearyl trimethyl ammonium bromide
14. hydrogenated tallow alkyl dimethyl(2-hydroxyethyl)ammonium chloride
15. tallow-alkyl methyl bis(2-hydroxyethyl)ammonium chloride
16. 2-(coco-acyloxy)ethyl trimethyl ammonium chloride
17. 2-(coco-acyloxy)ethyl methyl bis(2-hydroxyethyl-)ammonium chloride
18. coco-alkyl dimethyl(2-methoxy-2-oxoethyl)ammonium chloride
19. oleyl methyl bis(2-hydroxyethyl)ammonium chloride (b)

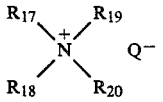

VI wherein $R_{17}$ and $R_{18}$ are the same or different and represent $C_6$–$C_{12}$ alkyl (both $R_{17}$ and $R_{18}$), $C_8$–$C_{18}$ alkyl ($R_{17}$) and $C_6$–$C_{10}$ branched alkyl ($R_{18}$) wherein $R_{19}$ and $R_{20}$ are the same or different and represent $C_1$–$C_4$ alkyl, benzyl, —$(C_2H_4O)_xH$ or $(C_3H_6O)_xH$ wherein x has a value from 1 to 5 wherein Q is an anion such as halide (preferably chloride or bromide), methosulphate or ethosulphate.

Of $R_{19}$ and $R_{20}$ not more than one group may be benzyl.

Examples of suitable representatives of this group (b) are:

1. dioctyl dimethyl ammonium chloride
2. hexyl decyl dimethyl ammonium chloride
3. didecyl dimethyl ammonium bromide
4. coco-alkyl 2-ethylhexyl dimethyl ammonium chloride
5. tallow-alkyl 2-ethylhexyl dimethyl ammonium chloride (c)

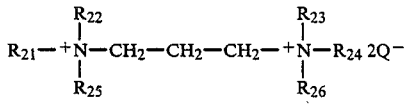

VII wherein $R_{21}$ is $C_8$–$C_{18}$ alkyl (saturated and/or unsaturated), wherein $R_{22}$, $R_{23}$ and $R_{24}$ represent $C_1$–$C_4$ alkyl, —$(C_2H_4O)_xH$, or —$(C_3H_6O)_xH$ wherein x has a value from 1 to 5, and wherein $R_{25}$ and $R_{26}$ represent $C_1$–$C_4$ alkyl; Q is an anion e.g. halide (preferably chloride or bromide), methosulphate or ethosulphate.

Examples of suitable representatives of this group (c) are:

1. 1,3-propane diaminium, N,N,N,N',N'-pentamethyl N'-coco alkyl dibromide
2. 1,3-propane diaminium, N,N,N,N',N'-pentamethyl N'-coco alkyl dichloride
3. 1,3-propane diaminium, N,N,N'-tris(2-hydroxyethyl)-N,N'-dimethyl-N'-coco alkyl dichloride
4. 1,3-propane diaminium, N,N,N'-tris(2-hydroxyethyl)-N,N'-dimethyl-N'-coco alkyl dibromide
5. 1,3-propane diaminium, N,N,N'-tris(2-hydroxyethyl)-N,N'dimethyl-N'-tallow alkyl dichloride 6. 1,3-propane diaminium, N,N,N'-tris(2-hydroxyethyl)-N,N'-dimethyl-N'-tallow alkyl dibromide.

(d)

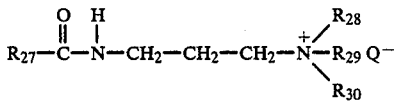

VIII wherein $R_{27}$ represents a $C_7$–$C_{17}$ alkyl (saturated and/or unsaturated) $R_{28}$, $R_{29}$ and $R_{30}$ are the same or different and represent $C_1$–$C_4$ alkyl, benzyl, $-(C_2H_4O)_xH$ or $-(C_3H_6O)_xH$, wherein x has a value from 1 to 5, Q is an anion such as halide (preferably chloride or bromide) methosulphate or ethosulphate while of $R_{28}$, $R_{29}$ and $R_{30}$ not more than one group may represent benzyl.

Examples of suitable representatives of this group (d) are:

1. N-(3-lauramido propyl)-N,N,N-trimethyl ammonium bromide
2. N-(3-lauramido propyl)-N,N,N-trimethyl ammonium chloride
3. N-(3-cocoamido propyl)-N,N,N-trimethyl ammonium chloride
4. N-(3-cocoamido propyl)-N,N-dimethyl-N-(2-hydroxyethyl)ammonium bromide.

The composition of the quaternary ammonium compounds to be used for the present fabric softening compositions may be prepared by the following methods:

The exemplified compounds 1–15 and 18–19 of the group a can be prepared from the corresponding tertiary amines which are commercially available (e.g. Armeen®, Ethomeen®), viz. by quaternisation with methylchloride, methylbromide, dimethyl sulphate, benzyl chloride, methyl chloroacetate or ethyl chloroacetate.

Such quaternisation reaction is usually carried out at 50°–110° C., using water or 2-propanol or mixtures thereof as an optional solvent.

The exemplified compounds 16 and 17 of the group a can be prepared by quaternisation as described hereinbefore of tertiary amines, which are obtained by esterification of 1 mole of fatty acid (e.g. coconut fatty acids) with 1 mole of N,N-dimethyl ethanolamine, or 1 mole of N-methyl diethanolamine or of 1 mole of triethanolamine. Such esterification can be performed at 150°–200° C.

The exemplified compounds 1–5 of the group b can be prepared from the corresponding secondary amines ($R_{17}R_{18}NH$) using, per mole of amine, 1 mole of methylation agent (methyl chloride, methyl bromide) in the presence of 1 mole of sodium hydroxide to convert the secondary amine into the tertary amine, and subsequently another 1 mole of the same methylation agent for conversion into the quaternary ammonium compound. These reactions are usually carried out at 50°–100° C., applying water or 2-propanol or mixtures thereof as the solvent.

The secondary amines can be obtained via several routes, the choice of which partly depends on the structure of the end product required. These routes are, e.g.:

hydrogenation of the corresponding alkylnitrile over a hydrogenation catalyst while venting off ammonia alkylation of ammonia by the corresponding alkanols, using hydrogen and a hydrogenation catalyst from a corresponding primary amine and a corresponding aldehyde; the imine formed from those is subsequently hydrogenated over a hydrogenation catalyst.

Such a procedure is described in U.S. Pat. No. 4,569,800.

The exemplified representatives 1–6 of the group c may be prepared from the corresponding diamines (Duomeen®) or ethoxylated diamines (Ethoduomeen®), viz. by methylation with methyl chloride or methylbromide at 50°–110° C.

The exemplified quaternary ammonium compounds 1–4 of the group d can be prepared by quaternisation of amido-amines which are obtained from N,N-dimethyl-1,3-propanediamine in a condensation reaction with the corresponding fatty acid at 170°–220° C. The quaternisation can be realized by using methyl chloride or methyl bromide at 50°–110° C. (ex. 1–3), or by using ethylene oxide and an equimolar amount of acid (e.g. HBr, ex. 4) at 40°–90° C.

The clays which may be suitably applied in the softening systems of the present invention may be selected from clay materials known for this purpose from, e.g., British patent publication No. 2,020,689 and European patent publication No. 0,026,529. Use is preferably made of the clays of the impalable smectite type, having an ion exchange capacity of at least 50 meq./100 g clay and preferably at least 70 meq./100 g clay having a particle size range from 5 to 50 microns (um).

Examples of such clays are alkalimetal montmorillonites (such as sodium montmorillonite), alkali metal saponites (such as sodium saponite), alkali metal hectorites (such as sodium or lithium hectorite) and alkaline earth metal compounds of these minerals, such as calcium montmorillonite. Examples of preferably used smectite clays are Gelwhite GP®, Volclay BC®, Imvite K® and Bentonite DT-X®.

The smectite type clay may be present in the softening composition in such an amount that it will be present in the complete detergent composition wherein the present softening compositions have been included, in an amount of from 1.5% to 45% by weight of the composition, preferably from 2% to 15% and more preferably from 4% to 12% by weight.

As indicated hereinbefore the fabric softener composition should further contain one or more amides, imides or urea derivatives according to the general formula I–IV.

Preferred compounds according to formula I are those, wherein at least one of the groups $R_1$ and $R_3$ is a long-chain alkyl group, i.e. either $R_1$ is $C_7$–$C_{21}$ alkyl or $R_3$ is $C_8$–$C_{22}$ alkyl or both represent such an alkyl group and wherein $y=1$.

Examples of compounds wherein A represents a carbonyl group are:

di(hydrogenated tallow)imide

N-acetyl-N-stearylstearamide

More preferably, a should represent a methylene group.

Examples of such compounds are:

N,N-di(hydrogenated tallow)acetamide

N,N-di(hydrogenated tallow)pelargonamide

N-coco stearamide

N-hydrogenated tallow cocamide

Most preferably $R_1$ represents $C_{11}$–$C_{21}$ alkyl groups, $R_2$ represents hydrogen or a $C_{11}$–$C_{21}$ alkyl group (A being methylene) and $R_3$ is hydrogen or a polyoxyalkylene group such as polyoxyethylene.

Examples of these preferred N-alkyl fatty amides are:

N-stearyl stearamide, N-stearyl tallow amide, N-stearyl hydrogenated tallow amide, N-oleyl palmitamide, N-oleyl tallow amide, N-stearyl erucamide, N-tallow tallow amide, 12-hydroxy-N-octadecyl octadecanamide, N-tallow oleamide, polyoxyethylene (5) oleamide, polyoxyethylene (5) tallow amide, polyoxyethylene (5) hydrogenated tallow amide, and polyoxyethylene (50) hydrogenated tallow amide.

Particularly preferred amides are N-stearyl stearamide, N-oleylpalmitamide, polyoxyethylene (5) oleamide, polyoxyethylene (5) hydrogenated tallow amide and polyoxyethylene (50) hydrogenated tallow amide.

The N-alkyl fatty amides can be prepared by reacting the corresponding fatty acid and fatty primary amine in a 1:1 molar ratio at 170°–220° C. for 5–10 hours while distilling off water from the condensation reaction mixture.

The preferred compounds of the group according formula II are those in which $R_5$ and $R_7$ represent $C_{12}$–$C_{22}$ alkyl groups and in which R6 and R8 are hydrogen.

Examples of such compounds are:

N-(hydrogenated tallow)-N'-octadecyl urea
N,N'-dioctadecyl urea
N-dodecyl-N'-octadecyl urea
N,N'-didoceyl urea
N-(13-docosenyl)-N'-octadecyl urea These urea derivatives can be prepared by reacting the corresponding alkyl isocyanate and alkyl amine at 25°–67° C. in tetrahydrofuran from which reaction mixture the urea derivative precipitates and can be isolated by filtration in 90–98% yield.

Preferred compounds of the group represented by formula III are those wherein $R_5$ and $R_6$ represent $C_{12}$–$C_{22}$ alkyl groups and wherein $R_6$ and $R_8$ represent hydrogen.

Examples of preferred representatives of this group are:

N,N'-dioctadecyl adipamide
N,N'-dioctadecyl azelaic amide
N,N'-dioctadecyl-1,4-cyclohexane dicarboxamide The compounds according to the formula III can be prepared by reacting the corresponding dicarboxylic acid and alkyl amine in a molar ratio of 1:2 at 170°–220° C. for 5–10 hours, while distilling off water from the condensation reaction mixture. Alternatively, these compounds can be prepared by reacting the corresponding dicarboxylic acid with the alkyl isocyanate until all the carbon dioxide has evolved, controlling the temperature at max. 150° C.

Preferred representatives of the group of compounds according to formula IV are those wherein $R_9$ and $R_{10}$ represent $C_{11}$–$C_{21}$ alkyl groups and wherein R11 and $R_{12}$ are hydrogen.

Examples of preferred compounds are:

ethylene bis-stearamide
methylene bis-stearamide
hexamethylene bis-lauramide
p-phenylene bis-palmitamide Most of these compounds can be prepared from the corresponding diamines in a condensation reaction at 170°–220° C. with 2 moles of fatty acid (per mole of diamine). Instead of diamines, the corresponding diisocyanates, if available, can be used in a reaction at more moderate temperatures. Methylene bis-stearamide can be prepared from stearonitrile (e.g. Arneel HT®) and formaldehyde (e.g. 1,3,5-trioxane) in the presence of water and an excess of strong acid (e.g. sulphuric acid) at temperatures below 50° C.

The application of amides according to formula I and more particularly the above-mentioned preferred representatives of this group form the most preferred embodiment of the present invention.

In the fabric softening composition the weight ratio between the amide, imide or urea derivative and the water soluble quaternary ammonium compound should be in the range of from 40:1 to 1:3 and preferably of from 20:1 to 2:1 and most preferably of from 16:1 to 4:1.

The weight ratio of the amide together with the soluble quaternary ammonium compound to the clay should be in the range of from 4:1 to 1:4 and preferably of from 1:1 to 1:3.

According to an alternative embodiment of the present invention, the softening composition further comprises an insoluble quaternary ammonium compound of the formula:

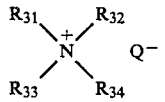

IX wherein $R_{31}$ and $R_{32}$ are the same or different and represent $C_{12}$–$C_{22}$ alkyl, groups wherein $R_{33}$ and $R_{34}$ are the same or different and represent $C_1$–$C_4$ alkyl groups, $-(C_2H_4O)_xH$ or $(C_3H_6O)_xH$ wherein x has a value of 1 to 5 and wherein Q represents a halide ion (preferably bromide or chloride ion), methosulphate or ethosulphate.

Examples of these compounds are:

di(hydrogenated tallow) dimethyl ammonium chloride
di tallow dimethyl ammonium chloride
di tallow-2-hydroxypropyl methyl ammonium chloride
di(hydrogenated tallow)-2-hydroxyethyl methyl ammonium chloride
di(hydrogenated tallow)-2-hydroxyethyl methyl ammonium bromide
di(hydrogenated tallow)dimethyl ammonium methosulphate
di(hydrogenated tallow)ethyl methyl ammonium ethosulphate The insoluble quaternary ammonium compound, if present in the softening composition, replaces the amide(s), imide(s) or urea derivative(s) to a certain extent. More preferably, the insoluble quaternary ammonium compound is present in a weight ratio of 1:2 to 2:1 relative to, e.g., the amide, the total amount of insoluble quaternary ammonium and of the amide present in the composition being in a ratio of 10:1 to 1:3 and preferably from 7:1 to 1:1 relative to the soluble quaternary ammonium. Furthermore, the total of insoluble quaternary ammonium, the amide, imide or urea derivative and the soluble quaternary ammonium are in a weight ratio to the clay of 4:1 to 1:4 and preferably from 2:1 to 1:2. The insoluble quaternary ammonium compound, if used, is usually present in an amount of 5–30% by weight, calculated on the softening composition.

A typical composition within the above-mentioned alternative embodiment consists of, e.g.

1–2 parts by weight of di(hydrogenated tallow)-dimethyl ammonium chloride
4–6 parts by weight of clay (Bentonite® DTX)
1–2 parts by weight of N-stearylstearamide
0.7–1.5 parts by weight of coco-alkyl trimethyl ammonium chloride.

A more preferred composition consists of, e.g.,

6–8 parts by weight of clay
1–4 parts by weight of N-stearylstearamide
0.1–1 parts by weight of coco-alkyl trimethyl ammonium chloride.

The detergent compositions which include the fabric softening composition can be prepared in various ways, as appropriate to their physical form, i.e. by mixing the components into a slurry followed by spray drying or other means of granulation, or by dispersing them in an appropriate liquid. The fabric softening composition which forms an independent feature of the present invention is prepared separately in the form of a granular powder, which may subsequently be admixed into the detergent base composition.

As to the preparation of the separate fabric softening composition, several ways of processing the three or four components into a granular powder are possible in principle. It is possible to mix the clay intensively with powdered amide, e.g. in a Nauta-mixer, and subsequently to add aqueous soluble quaternary ammonium at 50° C. over a period of 2 hours, and allowing excess water to evaporate. A suitable powder can then be obtained by grinding and sieving through 0.5 mm.

Alternatively, clay, aqueous soluble quaternary ammonium and insoluble quaternary ammonium can be homogenized in a stirred reactor, the slurry obtained can be extruded (e.g. 4.5 mm), the extrudate dried at 100° C. and ground. Powdered amide can then be added, followed by additional grinding and sieving through 0.5 mm.

Another possibility is to mix aqueous soluble quaternary (and optionally: insoluble quaternary) into the clay in a Nauta-mixer at 95° C. allowing excess water to evaporate. Subsequently, molten amide, imide or urea derivative can be added to 100° C. After further mixing and cooling, the granulate can be ground and sieved through 0.5 mm.

It is also possible to prepare a powdered mixture of soluble quaternary and insoluble quaternary by spray-drying, and to mix these powders with clay and with e.g. powdered amide. Grinding and sieving through 0.5 mm gives a suitable powder. The preferred method of processing is to prepare a hot dispersion of amide or the like and aqueous soluble quaternary (or optionally: insoluble quaternary) at 80°–100° C., and to add this dispersion to clay at 20°–60° C. in a Nauta-mixer. Mixing is continued for 2 hours at 40°–60° C., after which the cooled granulate is ground and sieved through 0.5 mm.

The present softening system may be incorporated into usual detergent compositions in an amount of 0.5 to 50% by weight, calculated on the complete detergent composition.

Preferably the softening composition is present in an amount of 2 to 20% and more preferably 4 to 12% by weight, calculated on the complete detergent composition.

The complete detergent compositions of the present invention may of course include additional components that are usually found in laundry detergents, as is known e.g. from European Patent Specification No. 0,026,529. These components include an anionic surfactant, in an amount of 3 to 40% by weight, calculated on the complete detergent composition, builder salts in amounts usually from 10 to 80% by weight, calculated on the complete composition and more preferably 30 to 60% by weight, bleaching agents in an amount usually from 5–35% by weight, calculated on the complete composition, bleach stabilizers, suds controlling or suppression agents, soil suspending and anti redeposition agents, enzymes, optical brighteners, colouring agents and perfumes in minor amounts ≦0.5% by weight, calculated on the complete composition.

The invention will be illustrated by the following examples, however without any restriction of the scope of the invention to these specific embodiments.

EXAMPLE 1

Several test washing compositions, containing different softening compositions were prepared from a standard test detergent composition consisting of:

| | |
|---|---|
| linear sodium akylbenzene suphonate | 6.4% |
| mean length of alkane chain 11.5 | |
| ethoxylated tallow alcohol (14 E.O.) | 2.3% |
| sodium soap | 2.8% |
| chain length | |
| $C_{12-16}$:13–26% | |
| $C_{18-22}$:74–87% | |
| sodium triphosphate | 35.0% |
| sodium silicate ($SiO_2$:$Na_2O$=3:3:1) | 6.0% |
| magnesium silicate | 1.5% |
| carboxymethylcellulose | 1.0% |
| sodiumethylenediaminetetraacetate | 0.2% |
| optical whitener for cotton (stilbene type) | 0.2% |
| sodium sulphate | 16.8% |
| water | 7.8% |
| sodium perborate tetrahydrate | 20.0% |

Starting from this basic composition final test formulations were prepared, comprising:

| | | |
|---|---|---|
| amide | 4.0% by weight | based on total composition |
| clay | 4.0% by weight | |
| coco-alkyl trimethyl ammonium chloride | 2.0% by weight | |
| or | | |
| amide | 4.0% by weight | based on total composition |
| clay | 6.0% by weight | |
| coco-alkyl trimethyl ammonium chloride | 1.0% by weight | |

In these compositions were used as amide respectively stearic stearyl amide, palmitic oleyl amide, erucic-hydrogenated tallow amide, 12OH-stearic-hydrogenated tallow amide and pelargonic acid-dihydrogenated tallow amide.

The final compositions were then used to clean a 4 kg wash load of terry towels at a 95° C. program, 18° dH in a Miele WS 1504 washing machine, the test detergent being employed in an amount of 260 g.

For softening evaluation treated towels are line dried for 24 hours and cut into swatches of 10×20 cm and graded by a test panel relative to the basic IEC test detergent and commercially available softergents as reference.

With these tests a significant superiority as to softening was found relative to the standard IEC test detergent and a similar softening as to commercially available softergents.

EXAMPLE 2

A series of test washing compositions containing different softeners as listed below were prepared from the standard test detergent composition as described in Example 1.

Final test compositions comprising respectively:

| | | |
|---|---|---|
| (a) stearyl stearamide | 4.0% by weight | based on total composition |
| clay | 6.5% by weight | |
| coco-alkyl trimethyl ammonium chloride | 0.5% by weight | |
| (b) clay | 6.5 by weight | based on total composition |
| coco-alkyl trimethyl ammonium chloride | 0.5% by weight | |
| (c) clay | 6.5% by weight | based on total composition |
| coco-alkyl trimethyl ammonium chloride | 0.5% by weight | |
| hydrogenated ditallow methylamine | 4.0% by weight | |

were prepared and their softening results were compared with each other and with that of a commercial washing composition (d). According to analysis, commercial washing composition (d) contains:

| | |
|---|---|
| nonionic detergent | 1.9% by weight |
| fatty acids | 1.0% by weight |
| linear alkyl benzene sulphonate | 4.0% by weight |
| clay | 6,5% by weight |
| coco-alkyl trimethyl ammonium chloride | 0.7% by weight |
| ditallow methylamine | 2.5% by weight |
| detergent builder salts | 73.9% by weight |

Comparison of the softening performance revealed that composition containing (a)>commercial composition (d)>composition containing (b)>composition containing (c).

EXAMPLE 3

A series of test washing compositions containing different softeners as listed below were prepared from the standard test detergent composition as described in Example 1.

The final test compositions comprising respectively:

| | | |
|---|---|---|
| (a) stearyl stearamide | 4.0% by weight | based on total composition |
| clay | 6.5% by weight | |
| coco-alkyl trimethyl ammonium chloride | 0.25% by weight | |
| (b) clay | 6.5 by weight | based on total composition |
| coco-alkyl trimethyl ammonium chloride | 0.25% by weight | |
| (c) clay | 6.5% by weight | based on total composition |
| coco-alkyl trimethyl ammonium chloride | 0.25% by weight | |
| hydrogenated ditallow methylamine | 4.0% by weight | |

were prepared and their softening results were compared with each other and with that of a commercial washing composition (d) as described in Example 2. Comparison of the softening performance revealed the following sequence of decreasing softening performance: composition containing (a)>commercial composition (d)>composition containing (b)>composition containing (c).

EXAMPLE 4

A series of test washing compositions containing different softeners as listed below were prepared from the standard test detergent composition as described in Example 1.

Test compositions comprising respectively:

| | | |
|---|---|---|
| (a) stearyl stearamide | 4.0% by weight | based on total composition |
| clay | 6.5% by weight | |
| stearyl dimethyl(2-hydroxyethyl) ammonium chloride | 0.5% by weight | |
| (b) clay | 6.5% by weight | based on total composition |
| stearyl dimethyl(2-hydroxyethyl) ammonium chloride | 0.5% by weight | |
| (c) clay | 6.5% by weight | based on total composition |
| stearyl dimethyl(2-hydroxyethyl) ammonium chloride | 0.5% by weight | |
| hydrogenated ditallow methylamine | 4.0% by weight | |

Comparison of the softening performance revealed that composition containing (a)>commercial composition (d)>composition containing (b)>composition containing (c).

EXAMPLE 3

A series of test washing compositions containing different softeners as listed below were prepared from the standard test detergent composition as described in Example 1.

The final test compositions comprising respectively:

| | | |
|---|---|---|
| (a) stearyl stearamide | 4.0% by weight | based on total composition |
| clay | 6.5% by weight | |
| coco-alkyl trimethyl ammonium chloride | 0.25% by weight | |
| (b) clay | 6.5 by weight | based on total composition |
| coco-alkyl trimethyl ammonium chloride | 0.25% by weight | |
| (c) clay | 6.5% by weight | based on total composition |
| coco-alkyl trimethyl ammonium chloride | 0.25% by weight | |
| hydrogenated ditallow methylamine | 4.0% by weight | |

were prepared and their softening results were compared with each other and with that of a commercial washing composition (d) as described in Example 2. Comparison of the softening performance revealed the same sequence as given in Examples 2 and 3.

EXAMPLE 5

A series of test washing compositions containing different softeners as listed below were prepared from the standard test detergent composition as described in Example 1.

Test compositions comprising respectively:

| | | |
|---|---|---|
| (a) stearyl stearamide | 4.0% by weight | based on total composition |
| clay | 6.5% by weight | |
| stearyl dimethyl(2-hydroxyethyl) ammonium chloride | 0.25% by weight | |
| (b) clay | 6.5% by weight | based on total composition |
| stearyl dimethyl(2-hydroxyethyl) ammonium chloride | 0.25% by weight | |
| (c) clay | 6.5% by weight | |

-continued

| | | |
|---|---|---|
| stearyl dimethyl(2-hydroxyethyl) ammonium chloride | 0.25% by weight | based on total composition |
| hydrogenated ditallow methylamine | 4.0% by weight | |

were prepared and their softening results were compared with each other and with that of a commercial washing composition (d) as described in Example 2.

Comparison of the softening performance revealed the same sequence as given in Examples 2–4.

EXAMPLE 6

A series of test washing compositions containing different softeners as listed below were prepared from the standard test detergent composition as described in Example 1.

Test compositions comprising:

| | | |
|---|---|---|
| stearyl stearamide | 4.0% by weight | based on total composition |
| clay | 6.5% by weight | |

and 0.25% by weight of one of the following ingredients:

coco-alkyl dimethyl(2-hydroxyethyl)ammonium chloride coco-alkyl trimethyl ammonium chloride stearyl dimethyl(2-hydroxyethyl)ammonium chloride, and oleyl bis(2-hydroxyethyl)methyl ammonium chloride, respectively were prepared and their softening results were compared with each other and with that of a commercial washing composition (d) as described in Example 2. Comparison revealed a sequence of decreasing softening performance similar to the afore-mentioned sequence of the quaternary ammonium compounds and all the compositions showed a better performance than the commercial composition (d).

EXAMPLE 7

A series of test washing compositions containing several softeners as listed below were prepared from the standard test detergent composition as described in Example 1.

Test compositions comprising:

| | | |
|---|---|---|
| clay | 6.5% by weight | based on total composition |
| coco-alkyl trimethyl ammonium chloride | 1.0% by weight | |

and 4.0% by weight of one of the following amides:

(1) stearyl stearamide, (2) polyoxyethylene (5) oleamide, (3) polyoxyethylene (5) hydrogenated tallowamide, and (4) polyoxyethylene (50) hydrogenated tallowamide, respectively were prepared and their softening results were compared with each other and with that of a commercial washing composition (d) as described in Example 2. Comparison revealed a sequence of decreasing softening performance: composition containing (1)=composition containing (2)=composition containing (3)≧commercial composition (d)>composition containing (4).

EXAMPLE 8

A series of test washing compositions containing different softeners as listed below were prepared from the standard test detergent composition as described in Example 1.

Test compositions comprising:

| | | | |
|---|---|---|---|
| (a) | clay | 8.0% by weight | based on total composition |
| | coco-alkyl trimethyl ammonium chloride | 0.25% by weight | |
| | stearyl stearamide | 2.0% by weight | |
| (b) | clay | 6.5% by weight | based on total composition |
| | coco-alkyl trimethyl ammonium chloride | 0.25% by weight | |
| | stearyl stearamide | 2.0% by weight | |
| (c) | clay | 6.5% by weight | based on total composition |
| | stearyl dimethyl(2-hydroxyethyl) ammonium chloride | 0.25% by weight | |
| | stearyl stearamide | 2.0% by weight | |

were prepared and compared as to softening performance with each other and the commerical washing composition (d) as described in Example 2. Comparison revealed a sequence of decreasing softening performance: composition containing (a)=composition containing (b)>commercial composition (d)>composition containing (c).

EXAMPLE 9

A series of test washing compositions, containing different softeners as listed below, were prepared from the standard test detergent composition as described in Example 1.

Test composition comprising:

| | | | |
|---|---|---|---|
| (a) | clay | 4.0% by weight | based on total composition |
| | ditallow dimethyl ammonium chloride, hydrogenated | 0.2% by weight | |
| | coco-alkyl trimethyl ammonium chloride | 2.0% by weight | |
| | stearyl stearamide | 2.0% by weight | |

-continued

| | | |
|---|---|---|
| (b) clay | 4.0% by weight | based on total composition |
| coco-alkyl trimethyl ammonium chloride | 2.0% by weight | |
| stearyl stearamide | 4.0% by weight | |
| (c) coco-alkyl trimethyl ammonium chloride | 2.0% by weight | based on total composition |
| stearyl stearamide | 4.0% by weight | |

were prepared and their softening results were compared with each other and with that of a commercial washing composition (d) as described in Example 2. Comparison revealed a sequence of decreasing softening performance: composition containing (a)≧commercial composition (d)>composition containing (b)≧composition containing (c).

EXAMPLE 10

A series of test washing compositions, containing different softeners as listed below were prepared from the standard test detergent composition as described in Example 1.

Test compositions comprising:

| | | |
|---|---|---|
| (1) clay | 6.5% by weight | based on total composition |
| coco-alkyl trimethyl ammonium chloride | 0.25% by weight | |
| N—stearyl stearamide | 2.0% by weight | |
| (2) clay | 6.5% by weight | based on total composition |
| coco-alkyl dimethyl(2-hydroxyethyl) ammonium chloride | 0.25% by weight | |
| N—stearyl stearamide | 2.0% by weight | |
| (3) clay | 6.5% by weight | based on total composition |
| coco-alkyl trimethyl ammonium chloride | 0.25% by weight | |
| N—oleylpalmitamide | 2.0% by weight | |
| (4) clay | 6.5% by weight | based on total composition |
| coco-alkyl dimethyl(2-hydroxyethyl) ammonium chloride | 0.25% by weight | |
| N—oleylpalmitamide | 2.0% by weight | |

were prepared and their softening results were compared with each other and with that of the commercial washing composition (d) as described in Example 2 and with that of the standard test detergent. Comparison revealed a sequence of decreasing softening performance: composition containing (1)>composition containing (2)>composition containing (3)=composition containing (4)>commercial composition>standard test detergent.

EXAMPLE 11

A series of test washing compositions containing different softeners as listed below were prepared from the standard test detergent as described in Example 1.

Test compositions comprising:

| | | |
|---|---|---|
| clay | 6.0% by weight | based on total composition |
| coco-alkyl trimethyl ammonium chloride | 1.0% by weight | |

and 4.0% by weight of one of the following:

(a) N,N-bis dodecylazelaic diamide, (b) N-decyl-N'-octadecyl-urea, and (c) ethylene diamine bis stearic acid amide, respectively were prepared and their softening performance compared with the commercial washing composition (d) as described in Example 2 and an analogous composition containing only clay and coco-alkyl trimethyl ammonium chloride (e). Comparison of softening performance revealed: composition containing (a)>commercial composition (d)=composition containing (b)>composition containing (c)>composition (e).

EXAMPLE 12

A series of test washing compositions containing different softeners as listed below were prepared from the standard test detergent as described in Example 1.

Test compositions comprising:

| | | |
|---|---|---|
| clay | 6.5% by weight | based on total composition |
| stearyl stearamide | 4.0% by weight | |

and 0.75% by weight of one of the following:

(a) N,N'-dimethyl-N,N',N'-bis(2-hydroxyethyl)-N-tallow-1,3-diammoniumpropane dichloride, (b) N-stearyl-N-octyl-dimethylammonium chloride, and (c) 1-trimethylammonium-3-cocoamid-propane chloride, respectively were prepared and their softening performance compared with the commercial washing composition (d) as described in Example 2. Comparison of softening performance revealed: composition containing (a)>composition containing (b)=commercial composition (d)>composition containing (c).

We claim:

1. A detergent compatible granular fabric softening composition comprising a water soluble quaternary ammonium compound and a clay having an ion-exchange capacity of at least 50 meq/100 grams, characterized in that it further comprises one or more amides, imides and urea derivatives selected from the group consisting of compounds having the formula:

(a)

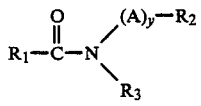

I wherein A represents a methylene or a carbonyl group wherein y represents 1 or 0, wherein $R_1$ represents a $C_1$–$C_{22}$ alkyl group, wherein $R_2$ and $R_3$, independently, can represent hydrogen, $C_1$–$C_{22}$ alkyl, $—(C_2H_4O)_xH$ or $—(C_3H_6O)_xH$, where x has a value of 1 to 25 with the provisos that the sum of the carbon atoms of two radicals of $R_1$, $R_2$ or $R_3$ is at least 16 and $R_2$ and $R_3$ are not at the same time hydrogen;

(b)

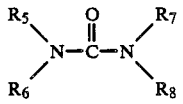

II wherein two of the groups $R_5$, $R_6$, $R_7$ and $R_8$ are the same or different and represent $C_8$–$C_{22}$ alkyl groups and two of the groups $R_5$, $R_6$, $R_7$ and $R_8$ are the same or different and represent hydrogen, $C_1$–$C_{22}$ alkyl, $—(C_2H_4O)_xH$ or $—(C_3H_6O)_xH$, where x has a value of 1 to 25;

(c)

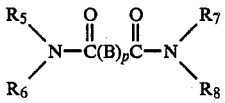

III wherein $R_5$, $R_6$, $R_7$ and $R_8$ have the same meaning as given under b, B represents $C_4$–$C_{10}$ alkylene, 1,3-phenylene, 1,4-phenylene, 1,3-cyclohexylene or 1,4-cyclohexylene and wherein p being 0 or 1;

(d)

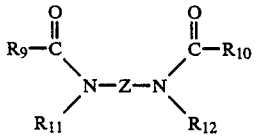

IV wherein Z represents $C_1$–$C_{12}$ alkylene, 1,3 phenylene, 1,4 phenylene, 1,3-cyclohexylene or 1,4-cyclohexylene, $R_9$ and $R_{10}$ are the same of different and represent $C_1$–$C_{21}$ alkyl groups, $R_{11}$ and $R_{12}$ are the same or different and represent hydrogen, $C_1$–$C_{22}$ alkyl, $—(C_2H_4O)_xH$ or $(C_3H_6O)_xH$, wherein x has a value of 1 to 25, or together with the moiety —N—Z—N— form a heterocyclic ring structure such as piperazinylene or imidazolidinylene.

2. A fabric softening composition according to claim 1 characterized in that the amide is of the formula

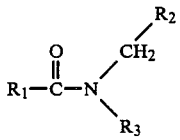

wherein $R_1$, $R_2$ and $R_3$ have the meaning as indicated above.

3. A fabric softening composition according to claim 2, characterized in that $R_1$ and $R_2$ are the same or different and represent $C_{11}$–$C_{21}$-alkyl groups and $R_3$ is hydrogen.

4. A fabric softening composition according to claim 2, characterized in that the amide is N-stearylstearamide, N-oleylpalmitamide, polyoxyethylene (5) oleymide, polyoxyethylene (5) hydrogenated tallow amide or polyoxyethylene (50) hydrogenated tallow amide.

5. A fabric softening composition according to claim 1, characterized in that the weight ratio of the amide, imide or urea derivative to the soluble quaternary ammonium compound is in the range of 40:1 to 1:3.

6. A fabric softening composition according to claim 5 characterized in that the weight ratio of the amide, imide or urea derivative to the soluble quaternary ammonium compound is in the range from 16:1 to 4:1.

7. A fabric softening composition according to claim 1, characterized in that the weight ratio of the amide plus the soluble quaternary ammonium compound to the clay is in the range from 4:1 to 1:4.

8. A fabric softening composition according to claim 1, characterized in that it further comprises an insoluble quaternary ammonium compound of the formula

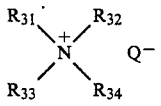

wherein $R_{31}$ and $R_{32}$ are the same or different and represent $C_{12}$–$C_{22}$ alkyl, groups $R_{33}$ and $R_{34}$ are the same or different and represent $C_1$–$C_4$ alkyl groups, $—(C_2H_4O)_xH$ or $(C_3H_6O)_xH$ wherein x has a value of 1 to 5 and wherein Q represents a halide ion, methosulphate or ethosulphate.

9. A detergent compositon characterized in that it contains a fabric softening composition according to claim 1.

10. A detergent composition according to claim 9, characterized in that it contains 3 to 40 percent by weight of anionic surfactant and 2 to 20 percent by weight of the fabric softening composition.

11. A detergent composition according to claim 9, characterized in that it contains 4 to 12 percent of the fabric softening composition.

* * * * *

UNITED STATES PATENT AND TRADEMARK OFFICE

CERTIFICATE OF CORRECTION

PATENT NO. : 4,851,138

DATED : July 25, 1989

INVENTOR(S) : Hans-Joachim JAROSCHEK ET AL

It is certified that error appears in the above-identified patent and that said Letters Patent is hereby corrected as shown below:

IN THE SPECIFICATION:

Col. 1, line 19, change "detergetnt" to --detergent--.

Col. 2, line 52, change "patent" to --Patent--.

Col. 3, line 46, change "2 methoxy-2-oxoethyl" to --2-methoxy-2-oxoethyl--;

line 67, change "oxyethyleen" to --oxyethylene--.

Col. 5, line 53, change "tertary" to --tertiary--.

Col. 6, line 55, change "a" (first occurrence), to --A--.

Col. 7, line 18, change "R6 and R8" to --$R_6$ and $R_8$--.;

line 52, change "R11" to --$R_{11}$--.

Col. 10, line 46, change "12OH-stearic" to --12-OH-stearic--.

Col. 14, at bottom of page, in the Table, insert --composition-- under "based on total".

UNITED STATES PATENT AND TRADEMARK OFFICE

CERTIFICATE OF CORRECTION

PATENT NO. : 4,851,138

DATED : July 25, 1989

INVENTOR(S) : Hans-Joachim JAROSCHEK ET AL

It is certified that error appears in the above-identified patent and that said Letters Patent is hereby corrected as shown below:

IN THE CLAIMS:

Claim 6, col. 18, line 26, after "5" insert --,--.

Claim 9, col. 18, line 49, change "compositon" to --composition--.

Signed and Sealed this

Third Day of July, 1990

*Attest:*

*Attesting Officer*

HARRY F. MANBECK, JR.

*Commissioner of Patents and Trademarks*